United States Patent [19]

Kukulies et al.

[11] 4,242,896

[45] Jan. 6, 1981

[54] APPARATUS FOR FORMING LONG WORKPIECES IN PRESSES

[75] Inventors: Erwin Kukulies; Guenther Dietrich, both of Duesseldorf, Fed. Rep. of Germany

[73] Assignee: Malmedie & Co. Maschinenfabrik GmbH, Duesseldorf, Fed. Rep. of Germany

[21] Appl. No.: 52,117

[22] Filed: Jun. 26, 1979

[30] Foreign Application Priority Data

Jul. 13, 1978 [DE] Fed. Rep. of Germany ..... 2830769

[51] Int. Cl.[3] ..... B21D 45/00

[52] U.S. Cl. ..... 72/345; 10/11 E; 72/421; 72/427

[58] Field of Search ..... 72/352, 344, 345, 420, 72/421, 427; 10/11 E, 11 T, 12 T

[56] References Cited

U.S. PATENT DOCUMENTS

| | | | |
|---|---|---|---|
| 2,964,003 | 12/1960 | Carper | 72/421 |
| 3,012,604 | 12/1961 | Zieg | 72/421 X |
| 3,605,499 | 9/1971 | Puletti | 72/345 |

FOREIGN PATENT DOCUMENTS 1577036 9/1971 Fed. Rep. of Germany .

*Primary Examiner*—Leon Gilden

[57] ABSTRACT

Apparatus for the forming of long workpieces, such as bolts, spindles, shafts, etc., in a press with shaping tools mainly consisting of a plunger and a die. An ejection channel for the workpiece passes through the plunger and is situated around the axis of the latter. The apparatus includes at least two opposed clamp jaws mounted for controlled movement toward and away from each other, and situated in the plunger but outside the ejection channel, the jaws gripping the workpiece before the processing of the latter and conveying it in a centered position to the processing point, the jaws at that time entering the said ejection channel. After the workpiece has been processed by the plunger and die, the plunger with the workpiece held by the jaws thereon return to their initial positions. The apparatus of the invention can be used to advantage in presses with conversion tools having multiple stages each with a plunger and die wherein the workpiece is transferred from one stage to the other.

6 Claims, 3 Drawing Figures

APPARATUS FOR FORMING LONG WORKPIECES IN PRESSES

Figure 1:
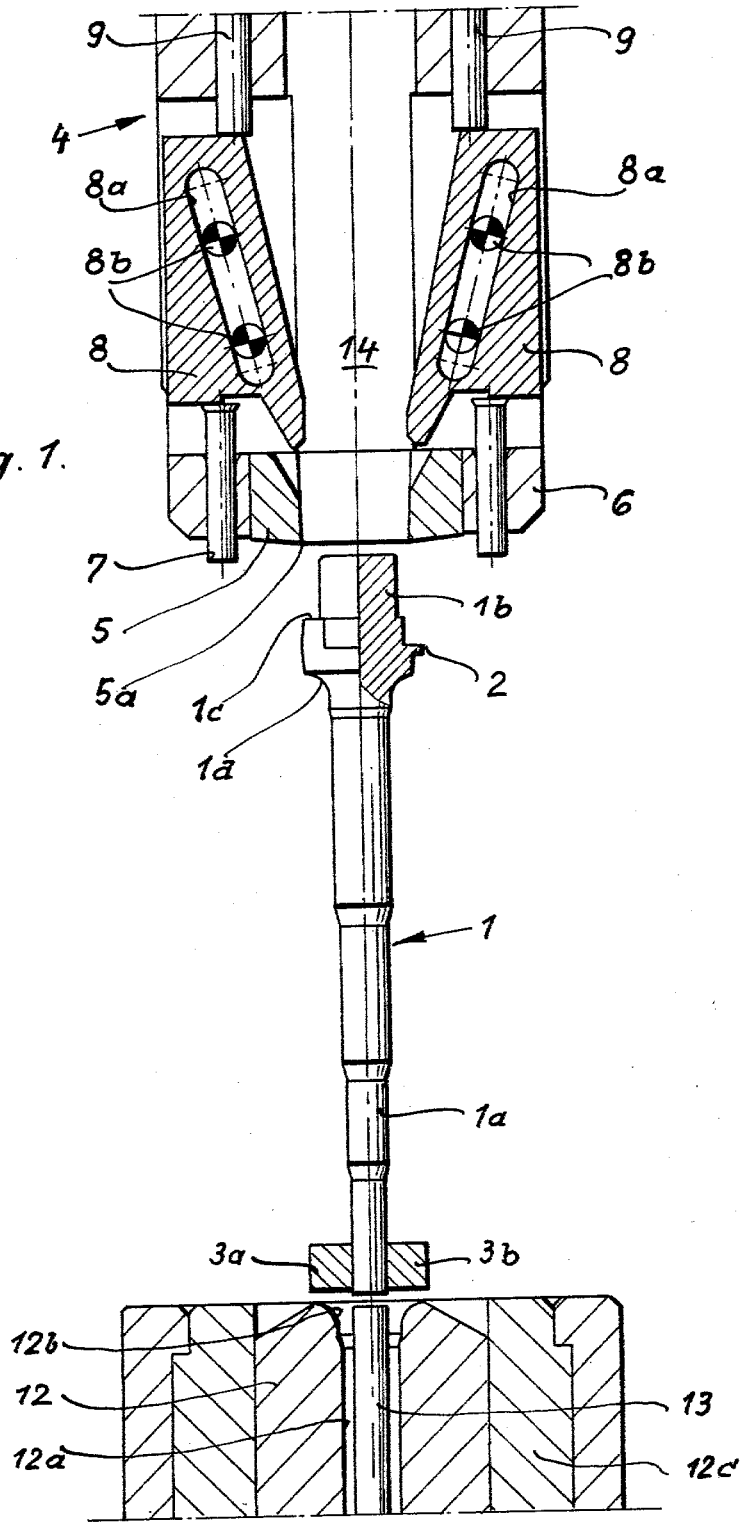

The invention relates to an apparatus for the forming of workpieces, such as bolts, spindles, shafts, etc., in presses with multi-stage conversion tools mainly consisting of plungers and dies, wherein an ejection channel for the workpiece passes through each plunger and is situated around the axis of the latter.

In multi-stage presses for the production of screws, bolts, buts, shaped parts or the like, use is generally made of ridig die tools combined in a block, on the one hand, and punching tools affixed to reciprocating slides moving toward and away from the die, on the other. In order to convey the workpiece from one operating station to another, cam-controlled gripper mechanisms are used. The plane of movement of these grippers is immediately adjacent to the front edge of the die. This enables the workpiece to be held in the grippers in front of the individual dies throughout a sufficient distance to enable them to be guided and held by the grippers. Only after the workpiece is held by the die are the grippers moved up out of the pressing zone.

Since the grippers, as described, have to be situated in the immediate vicinity of the front edge of the die, long workpieces can be gripped only at one end, away from their middles. In the case of bolt-shaped parts, the said gripped ends are always the reduced ends of the shanks, i.e., the ends having the smaller diameter, and never the frequently "upset" tops of the workpieces. The reason for this is that the reductions of the shanks are usually carried out in the die, whereas "upsetting" operations are generally performed in or on the punching tools. It follows that the centers of gravity of the workpieces are practically always located at the ends opposite from those engaged by the grippers.

These circumstances, taken with the acceleration and retardation of the workpieces in their transport movements, often cause their heads either to lag or to advance, i.e. the workpieces are caused to assume slanting positions with respect to the axes of the relevant dies and punching tools. This oblique position causes shaped parts to be produced which do not have the correct dimensions, and also leads to tool damage and other faults in the production process.

To reduce the output rate or increase the spring tension of the grippers is an unsatisfactory method, owing to the consequently reduced productivity or increased wear on the transport mechanism. Other aids, such as additional camcontrolled supporting devices, such as those disclosed in German Pat. No. 1,577,036, involve expense and cannot be subsequently incorporated in an existing multi-stage press.

The purpose of the invention is to enable these defects to be avoided by simple means and without causing disadvantages in other parts of the apparatus.

The invention achieves this object by the provision of at least two controlled movable clamp jaws, three being preferred, which are disposed in the plunger but outside its ejection channel and which take over the workpiece before the processing of the latter and convey it in a centered position to the processing point, while entering the said ejection channel, which then returns the workpiece to its initial position after it has been processed.

According to a further characteristic of the invention, the clamp jaws are provided with guide cross pins or bolts enabling them to open and close, the cross pins passing through oblique slots in the jaws, the jaws being held in the closed position by spring means and via plungers, and a plunger plate, while the clamp jaws can be opened by second pins which are mounted loosely in the plunger and which rest at one end against the die when the plunger approaches the die and at the other end against the said clamp jaws.

Finally, the second pins are of such length that when making impact with the die they bring the clamp jaws to a stop, causing them to open at the same time, while the plunger continues to move forward in the direction of the die.

Figure 2:
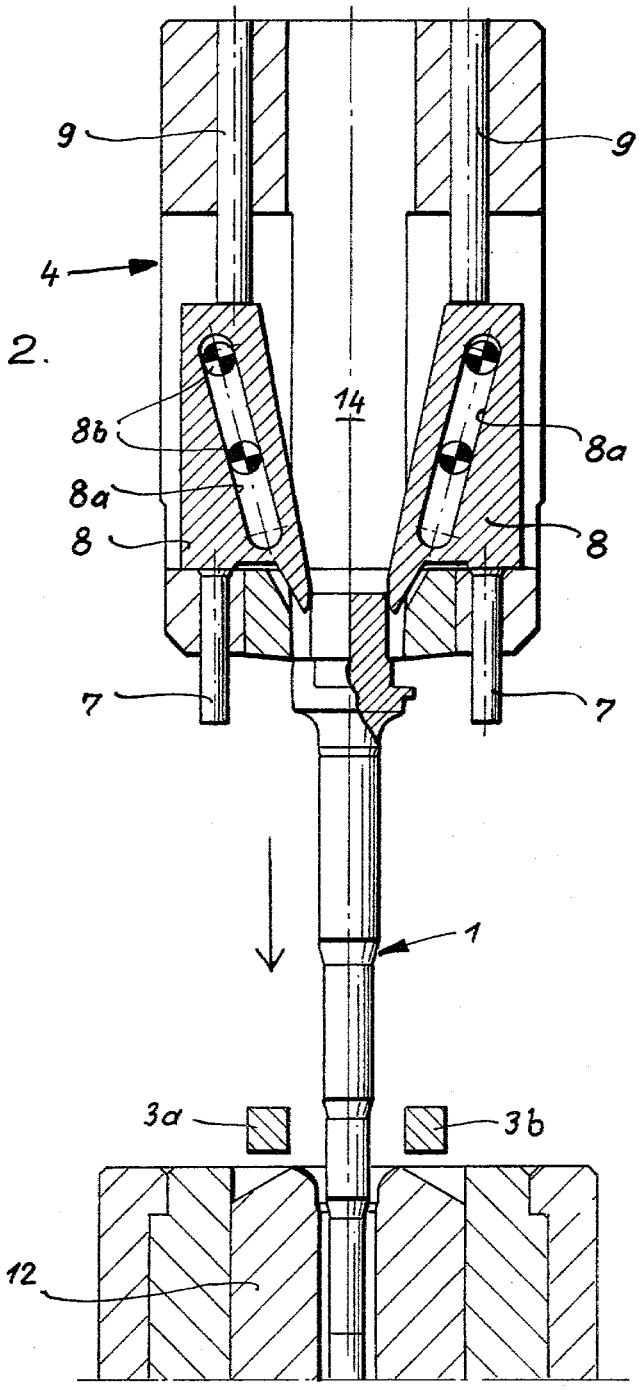
Figure 3:
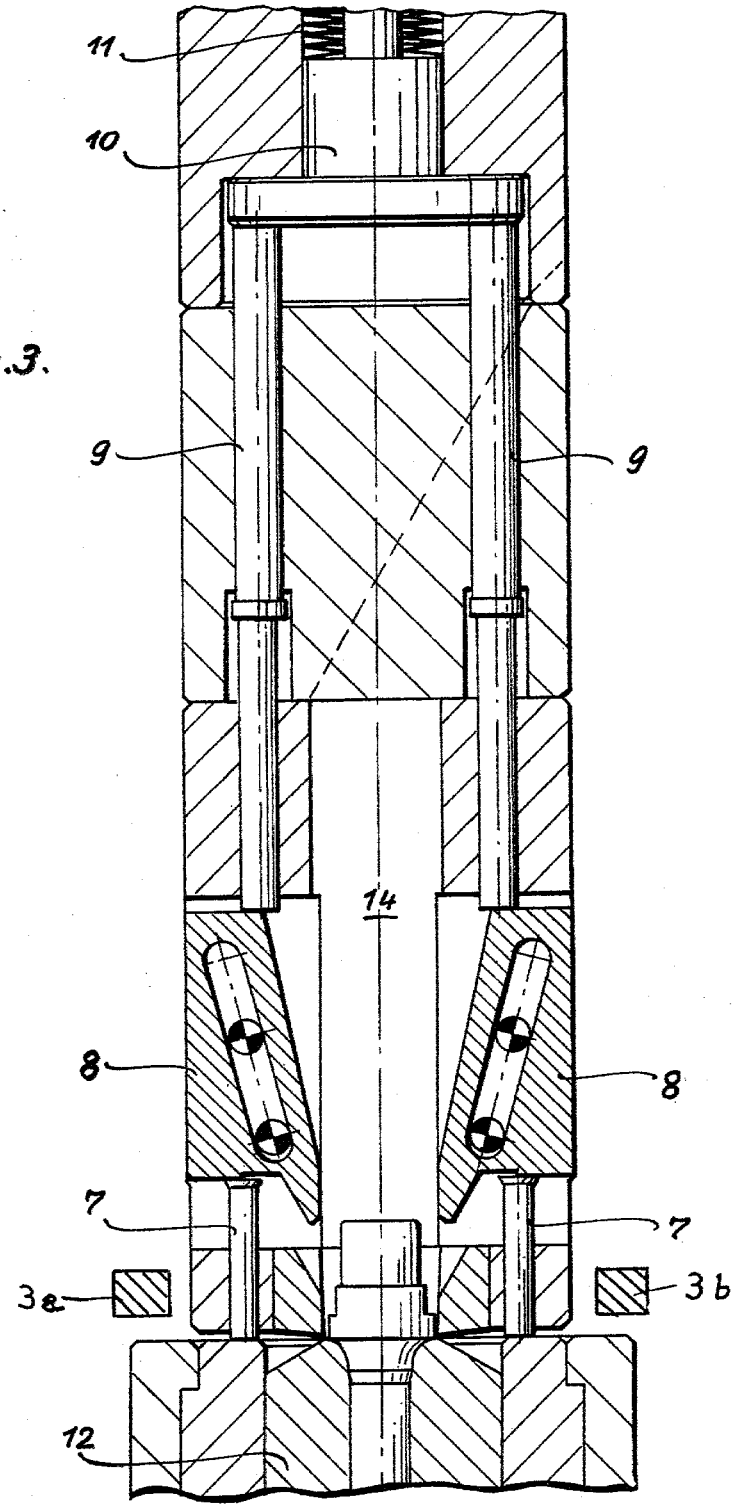

The invention will be explained in greater detail by reference to an example and by means of the accompanying drawings, in which:

FIG. 1 is a view in longitudinal section through the last tool stage of a multi-stage press, the press plunger being shown in its initial position, the section being taken along two longitudinal axial planes disposed at an angle of 120° with respect to each other, FIG. 2 is a view in longitudinal section similar to FIG. 1, through the tool stage shown in FIG. 1, the parts being shown during operation of the plunger, and FIG. 3 is a view in longitudinal section similar to FIG. 1 through the tool stage shown in FIGS. 1 and 2, the parts being shown after the workpiece shaping operation of the plunger and immediately before the ejection of the workpiece.

The last tool stage of a multi-stage press is shown in the drawings. In such stage the only operation to be carried out is the removal of flash from, or the deburring of, the workpiece 1. Such operation has been preceeded by three other processing stages in which the end of the shank is made thinner and the head of the workpiece 1 is made thicker by workpiece shaping processes.

In FIG. 1 the workpiece 1 with its shank 1*a*, head 1*b*, shoulder 1*c*, radius 1*d* below the head and burr or flash 2 present on the head is held in front of the fourth conversion station of the multi-stage press by a pair of opposed grippers 3*a* and 3*b*. Pins 7, provided with a countersunk head, are mounted in an annular plate 6 on the plunger 4 in such manner that they can slide axially with respect to the plunger. The plunger 4 also contains three clamp jaws 8 (two shown) which are spaced at equal angles about the axis of the plunger 4 and which are slidably guided in oblique slots 8*a* by the aid of guide bolts or first, cross pins 8*b* passing through the slots 8*a*, so that the clamp jaws can close and open centrally in the course of their axial movement. For the closing operation, three plungers 9 spaced at equal angles about the axis of plunger 4, are provided, plungers 9 being actuated by a plunger plate 10 and a plurality of coil compression springs 11. An ejection channel 14 is provided along the axis of the plunger 4. The plunger has a cutting ring 5 affixed to the plate 6, ring 5 having a flash cutting inner edge 5*a*.

As regards the die part of the apparatus, as shown in the drawings there is a die 12 with a bore 12*a*, a mouth 12*b*, a casing 12*c* and an ejector pin 13 extending axially through the bore 12*a* of the die.

The method of operation of the above described apparatus will be apparent in FIGS. 1, 2, and 3 of the drawing:

In FIG. 1, grippers 3*a* and 3*b* are shown holding the workpiece by its lower thin shank end in front of the bore in the die 12. The clamp jaws 8 are then in their lower and radially inward positions.

The plunger 4 begins to move downwardly in the direction of the die 12 and the head 1*b* of the workpiece 1, which is still held by the grippers 3*a* and 3*b*, enters the bore of the cutting ring 5. The upper end of the head 1*b* of the workpiece 1 engages the lower ends of the clamp jaws 8, thrusting them upwardly against the opposition of coil compression springs 11 and radially outwardly by reason of the interaction of cross pins 8*b* and the oblique slots 8*a* in the clamp jaws. The jaws thus receive the upper end of the head 1*b* of the workpiece 1 between them, grip it, and center the workpiece with respect to the cutting ring 5 and the die 12. The grippers 3*a* and 3*b* are now separated, as shown in FIG. 2, to release the workpiece, grippers 3*a* and 3*b* eventually reaching an outer terminal position, shown in FIG. 3, in which they have been removed from between the plate 6 and the die 12.

In FIG. 3 the clamp jaws 8 have reached their upper terminal position with respect to the plunger 4 and cease their axial movement with respect thereto. The plunger 4, however, has moved further in the direction of the die 12; the clamp jaws 8 hold the head 1*b* of workpiece 1 in a clamped position, the cutting edge 5*a* of cutting ring 5 makes contact with the shoulder 1*c* of the head of the workpiece, the shank end 1*a* of the workpiece has completely entered the bore 12*a* of the die 12, the ejector pin 13 has moved downwardly, and the pair of grippers 3*a* and 3*b* have fully opened. The plunger 4 has reached its lowermost terminal position immediately in front of the die 12, the shank 1*a* of the workpiece 1 is disposed within the bore 12*a* of the die, the radius 1*d* underneath the head 1*b* of the workpiece is disposed in the correspondingly shaped mouth 12*b* of the die, and the flash removing operation on the head 1*b* has been carried out by means of the opposed cutting edges 5*a* on the plunger 4 and that on the die 12.

The second pins 7 associated with the three clamp jaws 8 have opened such jaws by the axial displacement of the pins 7 caused by the contact between the pins and the holding frame 12*c* of the die during the downward movement of the plunger 4. This leaves, along the axis of the plunger, a channel-shaped free space 14 through which the workpiece 1, which has now been finally shaped, can be ejected by upward movement of the ejector 13. This is followed by the actual ejection operation, not shown in the drawings.

In the above description the words "upwardly" and "downwardly" are employed only to designate directions of the parts and their movements relative to each other, since the plungers of the press may be disposed to reciprocate either vertically, as shown in the drawings, or horizontally.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. In apparatus for forming a long workpiece, said apparatus including a press with at least one plunger and a die cooperating therewith for shaping the workpiece, the improvement which comprises an ejection channel for the workpiece passing axially through the plunger, at least two opposed clamp jaws mounted on the plunger, and means for selectively moving the clamp jaws away from each other and out of the ejection channel, and toward each other so that a portion of each clamp jaw projects into the ejection channel to grip a first end of a workpiece projecting into the ejection channel in the plunger and to center the workpiece with respect to the die, the clamp jaws advancing the workpiece with the plunger toward the die for shaping the workpiece between the die and plunger, and retracting the workpiece from the die with the plunger after the shaping operation.

2. Apparatus in accordance with claim 1, wherein the press is a multi-stage press, each stage of the press including the improvement set forth in claim 1.

3. Apparatus in accordance with claim 2, wherein each stage of the press has gripping jaws associated therewith for gripping the other, second end of the workpiece and centering it with respect to the respective die prior to the engagement with and the gripping of the first end of the workpiece by the clamp jaws.

4. Apparatus in accordance with claim 2, wherein the means for moving the clamp jaws toward and away from each other comprises oblique slots in the jaws, said slots receiving first, cross pins affixed to the plunger, whereby movement of the clamp jaws in opposite directions axially of the plunger causes the clamp jaws to approach and move away from each other, respectively, yieldable means for constantly urging the clamp jaws axially of the plunger in such direction as to cause the jaws to approach each other, and means responsive to the approach of the plunger to the die to separate the clamp jaws.

5. Apparatus in accordance with claim 4, wherein the oblique slots in the clamp jaws are inclined in such direction that movement of the clamp jaws with respect to the plunger in a direction away from the die causes the clamp jaws to move away from each other, the means responsive to the approach of the plunger to the die to separate the clamp jaws comprises at least one second pin for each clamp jaw, said second pins being mounted on the plunger for axial movement with respect thereto, each second pin having a first outer end disposed in alignment with a part of the die and an inner end disposed in alignment with the respective clamp jaw, the second pins thrusting the clamp jaws in a direction away from the die when the plunger approaches the die.

6. Apparatus in accordance with claim 5, wherein the length of the second pin is such that when they engage the die, they bring the clamp jaws to a stop at the end of their opening movement, the plunger then continuing to move forward in the direction toward the die.

* * * * *